United States Patent [19]

Ethridge et al.

[11] Patent Number: 4,811,873

[45] Date of Patent: Mar. 14, 1989

[54] SELF-STRIPPING PLEATING APPARATUS

[75] Inventors: Edwin C. Ethridge; Jerry L. Johnson, both of Huntsville, Ala.

[73] Assignee: Smock Right, Inc., Huntsville, Ala.

[21] Appl. No.: 50,874

[22] Filed: May 18, 1987

[51] Int. Cl.[4] ..... D05B 35/08; D05B 1/04; D06J 1/04

[52] U.S. Cl. ..... 223/32; 112/174

[58] Field of Search ..... 223/32; 112/132, 133, 112/134, 174

[56] References Cited

U.S. PATENT DOCUMENTS

| | | | |
|---|---|---|---|
| 376,995 | 1/1888 | Taylor et al. | 223/32 |
| 735,458 | 8/1903 | Bunnell et al. | 112/224 |
| 1,751,796 | 3/1930 | Denner | 223/102 |
| 2,279,662 | 4/1942 | Denner | 223/102 |
| 3,767,091 | 10/1973 | Dalske et al. | 223/32 |
| 4,323,021 | 4/1982 | Durand | 112/133 |
| 4,364,494 | 12/1982 | Shive, Jr. | 223/32 X |

FOREIGN PATENT DOCUMENTS

| | | | |
|---|---|---|---|
| 60-158893 | 8/1985 | Japan | 112/222 |
| 4970 | of 1878 | United Kingdom | 112/174 |
| 13277 | of 1891 | United Kingdom | 112/174 |
| 643093 | 9/1950 | United Kingdom | 223/32 |

OTHER PUBLICATIONS

Research Disclosure (Feb. 1981) No. 202 5 1681 0041 entitled "Sewing needles".

*Primary Examiner*—Robert R. Mackey
*Attorney, Agent, or Firm*—C. A. Phillips

[57] ABSTRACT

A pleating machine having a frame supporting two pairs of rollers formed with intermeshing teeth. Each pair is comprised of upper and lower intermeshing rollers, with a roller of the first pair intermeshing with a roller of the second pair to form a continuous train of gears. Each roller is provided with registering circumferential grooves along the length thereof. A needle having a pointed tip end and an eye end is disposed in "floating" relation in the machine with its pointed end positioned between the first pair of rollers (entrance rollers) and with its eye end extending just beyond the second pair of rollers. The needle is provided with a predetermined length which extends from the pointed tip to the eye end of the needle which is disposed proximate an arc prescribed by rotation of a point on the outer periphery of the lower of the second set (exit) of rollers.

11 Claims, 2 Drawing Sheets

SELF-STRIPPING PLEATING APPARATUS

FIELD OF THE INVENTION

This invention relates generally to sewing machines and particularly to such a machine disposed for uninterrupted pleating of an indefinite length of textile fabric or other sheet material by passing the material between intermeshed toothed rollers which produce pleats and impale the material onto needles supported by the rollers.

BACKGROUND ART

Different types of apparatus for pleating textiles and other materials are known in the art and have been used for many years. The patent to Read, British Pat. No. 643,093, issued Sept. 15, 1950, describes a pleater utilizing two pairs of intermeshed rollers that pleat the material with floating needles riding in slots in the rollers that stitch the material. Material is fed into the throat of the first pair of rollers which pleat and stitch the material with the floating needles. Then the material is passed between a second set of rollers to be carried out of the apparatus. Further turning of the rollers draws more material into the apparatus, pleating the material and driving it through the apparatus and onto the shank portion of the needles. The pleats of the material are caused to lie flat against each other because of the bunching which occurs due to the frictional resistance of the needles.

The patent to Durand, U.S. Pat. No. 4,323,021, issued Apr. 6, 1982, discloses an improvement to the Read device and incorporates additional supporting rollers to support two of the rollers that bend under the forces generated during pleating.

Both references describe a pleating apparatus which uses an S-shaped needle mounted in floating relation in the spaced, parallel grooves of the rollers. Neither of the references is concerned with the specific structure of the needle relating to the length thereof and critical relationship of the positioning of the eye of the needle relative to the rollers of the pleating apparatus or the positioning of the eye end of the needle relative to any other aspect of the needle. In both of the references, the eye end of the needle extends a considerable length beyond the arc prescribed by rotation of a point on the outer periphery of the lower roller. Such extended length creates significant frictional resistance to material flow, which results in the bunching of the material on the eye end of the needle.

This bunching causes significant frictional resistance to material flow with most materials. When the accumulated pleats fill the needle shaft, the pleating operation must be stopped in order to manually strip material off the end of the needles onto the trailing threads, thus clearing the needles to receive more pleats. This is a highly bothersome, but currently absolutely necessary, procedure which results in repeated interruptions, i.e., a series of short stop-and-go operations. As pleated material accumulates on the needle, resistance to material motion builds to such large forces that the accumulated pleats are compressed from the needle eye toward and against the rotating teeth of the last roller gear. These compressed pleats wedge into and under the small bottom roller and create such a severe impasse for roller rotation and material flow as to totally halt the operation. If further or forced operation is attempted, such large forces are generated that needles are broken or bent, and in some cases, the small rollers or the support members are also bent.

Another disadvantage of the bunching of material onto the needle, requiring manual stripping to remove the material from the needle, is that the use of self-threading needle eyes is prohibited. The manual stripping action very frequently pulls the thread from the eye, ruining the process. The decreased resistance to pleating the material brought about by the self-stripping aspect of the invention permits the utilization of self-threading eyes on the needle.

Additionally, if it were desired to design a machine having a larger capacity, one would increase the number of needles and lengthen the rollers. However, increasing the number of needles of the prior art devices increases the resistance to material flow, subsequently increasing the loading on the rollers and thus limiting the number of needles and the ultimate width of the material that can be pleated.

Applicants' device eliminates the problems associated with the frictional resistance inherent in the extended needle shanks of the above-discussed references by providing a needle for use in such machines which will eliminate the adverse frictional resistance therein.

Applicants' device uses a needle of predetermined length having its eye end positioned proximate an arc prescribed by rotation of a point on the periphery of the lower of a pair of upper and lower intermeshed exit rollers of the pleater. The positioning of the eye end of the needle proximate this arc permits the last roller of the set of intermeshed rollers to propel the material off the end of the needle, permitting uninterrupted operation and reduced resistance to operation.

SUMMARY OF THE INVENTION

A self-stripping pleating apparatus for forming pleats, gathers, and the like in textile fabrics or sheet material of an indefinite length in a continuous uninterrupted operation. The machine includes a frame supporting two pairs of upper and lower rotatable rollers formed with intermeshing teeth. A roller of one pair intermeshes with a roller of the second pair, and each roller is provided with registering circumferential parallel grooves spaced along the length thereof. S-shaped needles are mounted in the grooves with the pointed tip disposed between the rollers of the first or entry pair of rollers and the eye end proximate an arc prescribed by rotation of a point on the periphery of the last or lower roller of the second or exit pair of intermeshed rollers. This unique geometrical relationship between the needle eye end and the lower exit roller enables the apparatus to push each fold of the material (pleat) off and over the eye end of the needle as the pleat is formed. The pleat is pushed off the needle with a positive and evenly distributed force, thereby preventing any accumulation or bunching of pleated material which would halt the operation of the pleating process.

DETAILED DESCRIPTION OF THE INVENTION

Figure 1:
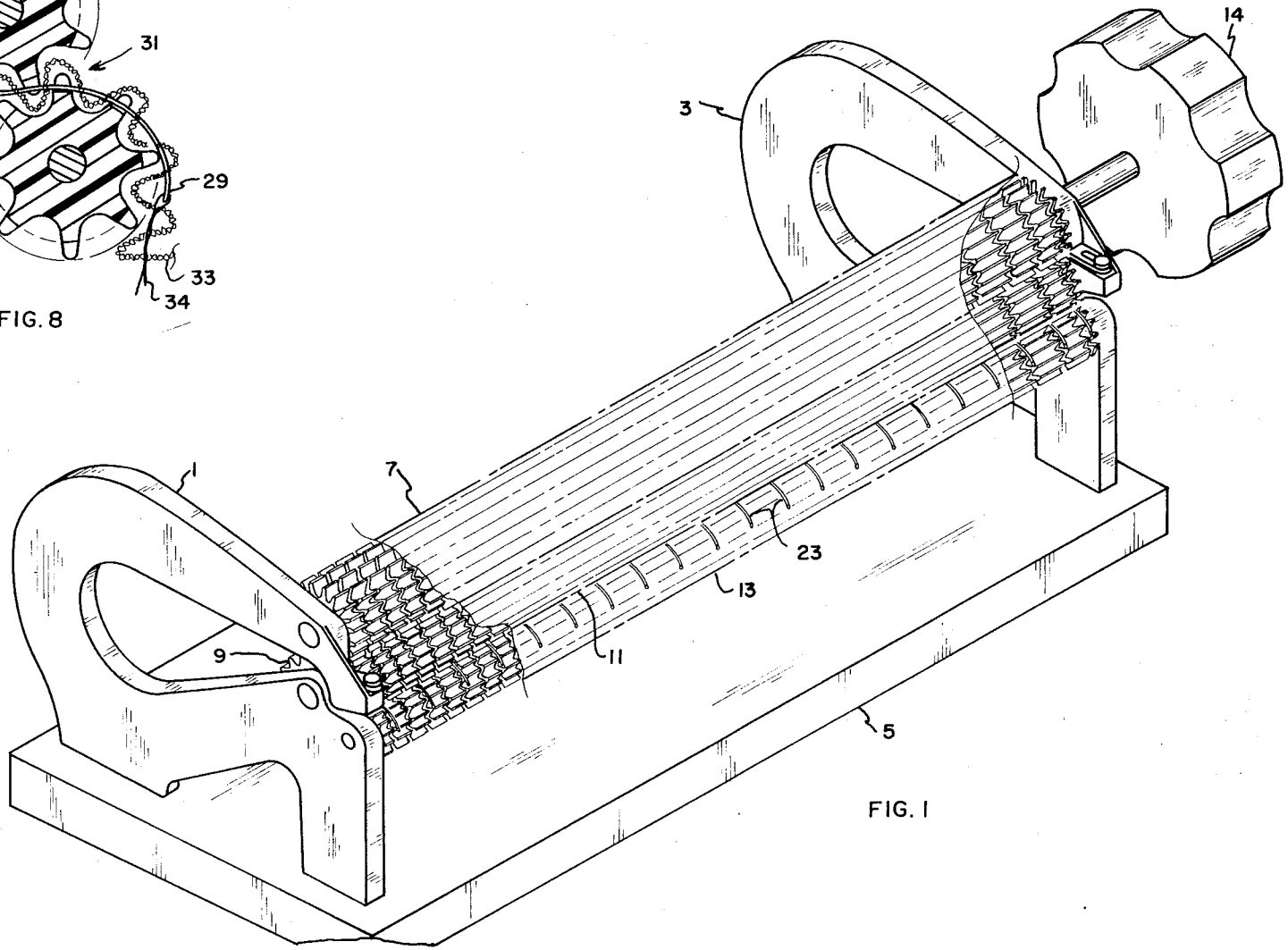
FIG. 1 is a perspective view of the pleating machine of the present invention.

Referring to the drawings, as seen in FIG. 1, two end members 1 and 3 are attached to and supported by a base 5. The end members in turn position and support four intermeshed toothed rollers 7, 9, 11, and 13. The rollers are turned by knob 14 or other means attached to first roller 7, this roller being intermeshed with the next roller 9, causing roller 9 to rotate. Rollers 7 and 9 form an entrance set of rollers for the material to be pleated, and rollers 11 and 13 form an exit set of rollers. Roller 9 is intermeshed with roller 11 for rotation of roller 11, and roller 11 rotates roller 13. Rollers 11 and 13 form an exit set of rollers for ejection of the material being pleated. Circumferential grooves are located at spaced locations along the rollers, the grooves of each roller lying in the same transverse plane as corresponding grooves in the other three rollers. The co-planar grooves are referred to as a set of grooves being indicated as 15, 17, 19, and 21 in the respective rollers 7, 9, 11, and 13.

The needles are maintained in a floating condition within the grooves of the rollers. The grooves provide four points of support for S-shaped needles placed in the grooves forming a series of needles abreast of and parallel with each other. Each needle 23 has a pointed end 25 (FIG. 3) on the entrance side 27 of the entrance roller array and a thread attaching eye 29 on the exit side 31 of the exit roller array. The bottoms and sides of the grooves act to limit needle motion coming into contact with the needle by securing its position against possible movement due to the resistance forces encountered as the cloth is passing over the needle.

The operation of the pleating machine consists of offering the leading edge 33 of material to the entrance side 27 of the roller array and rotating the drive roller. The material becomes enveloped between rollers 7 and 9 following the contour of the rollers. Further rotation of drive roller 7 draws more material into the machine. As the point 25 of the needle is contacted, the material is impaled on the needle and the material is stitched. Further rotation of drive roller 7 forces material through the intermeshed rollers following the contours of the rollers each in succession being constrained from unfolding by the needle in the folded material.

Figure 3:
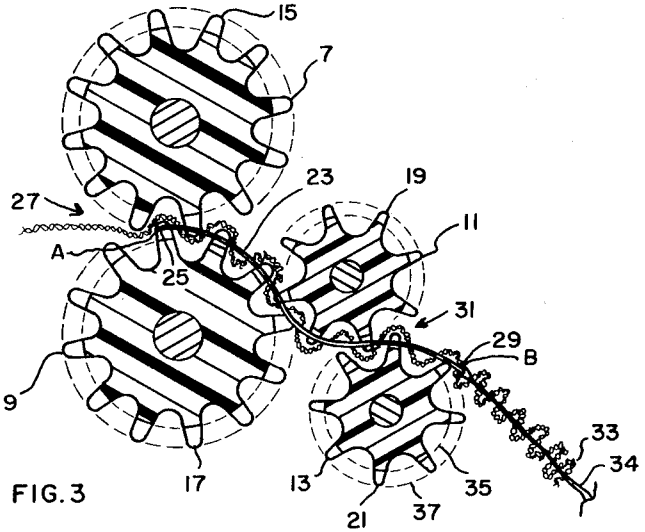
FIG. 3 is a vertical sectional view through the rollers showing one of the needles in its supported position in the larger diameter entrance pair of rollers and the smaller diameter exit pair of rollers.

As can be more clearly seen in FIG. 3, the pointed end 25 of the needle is positioned at a point A between rollers 7 and 9, and the eye end of the needle is positioned at a point B adjacent roller 13, permitting roller 13 to propel the material off the end of the needle onto thread 34. As can also be seen in FIGS. 3–6, as roller 13 rotates, a circumferential arc 35 is prescribed by the bottom surface of grooves 21 in roller 13, and a second arc 37 is prescribed by a point on the outer periphery (circumference) of roller 13. The needle eye extends just slightly beyond arc 37 so that it is sufficiently exposed to permit unencumbered threading of the needle.

Figure 7:
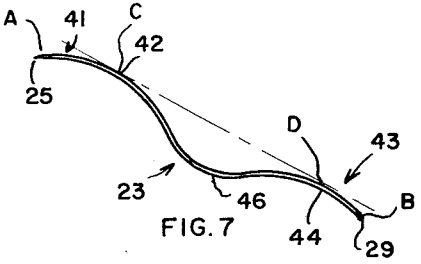
FIG. 7 is an elevational view of the needle and illustrates the relationship of the needle curves and length.
Figure 5:
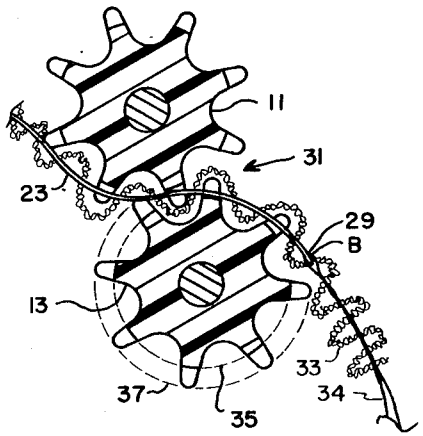
FIGS. 4, 5, and 6 are vertical sectional views through the exit pair of rollers illustrating the rollers at various positions during operation of the device.
Figure 4:
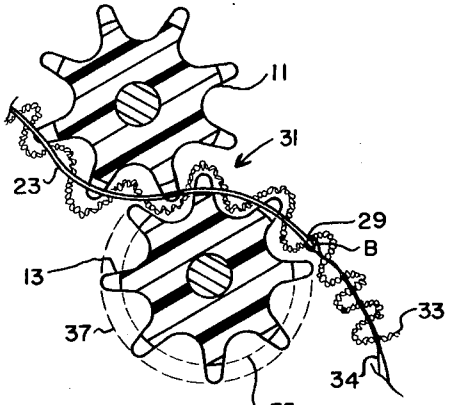
Figure 6:
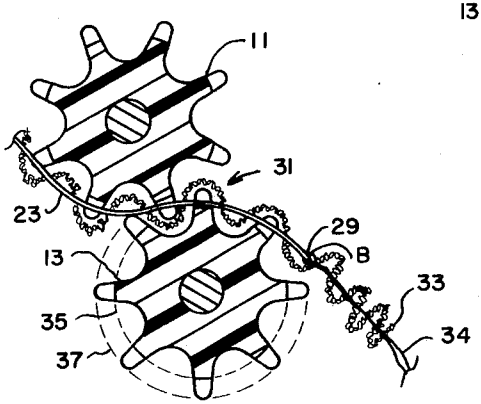
Figure 2:
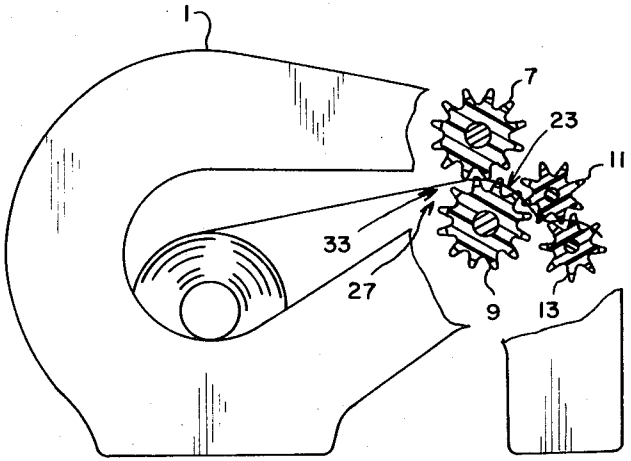
FIG. 2 is an end elevational view, partially in section, of the pleating machine of FIG. 1.

FIG. 7 illustrates a geometrical relationship between features of the invention which further define the invention. As seen in FIG. 7, needle 23 is comprised of a shank or body having a first end portion 41 terminating in pointed end 25 (A) and a second end portion 43 terminating at eye end 29 (B). An intermediate shank portion is disposed between points A and B and includes a pair of similarly curved sections 42 and 44 jammed by an inversely curved section 46 to form a needle having a substantially S-shaped configuration. Sections 42 and 44, respectively, include points C and D which mark points of tangency by a straight line to the curved sections 42 and 44. The length of the distance between points B to D is a predetermined distance which is critical to the self-stripping action of the pleating apparatus on the material on the needle. It has been determined that if the distance from point B to D is less than approximately 0.6", the eye is proximate the outer arc 37 of the last roller 12 of the disclosed pleating apparatus, and self-stripping action occurs with most common textile materials. It has been found that it becomes increasingly difficult for the needles to self-strip if the aforementioned distance between points D and B exceeds approximately $\frac{3}{8}$". However, at distances below $\frac{3}{8}$", the material self-strips easily. For most practical applications, in the disclosed pleating apparatus, the dimension D-B of $\frac{3}{8}$" would approach the maximum practical limit even though the apparatus would still self-strip at $\frac{1}{2}$". Specifically, the preferred dimension of D-B, however, is 0.275±0.06". The length of the needle, therefore, is defined as the length the needle extends from point A to point B, and the critical predetermined length of the eye end portion of the needle shank which extends from points D and B is such that point B is located proximate an arc 37 prescribed by rotation of a point on the outer periphery of roller 13. Specifically, the eye is located within the approximate range of 1/64" to $\frac{3}{8}$" externally of arc 37, measured in the direction of the radius of the arc.

Figure 8:
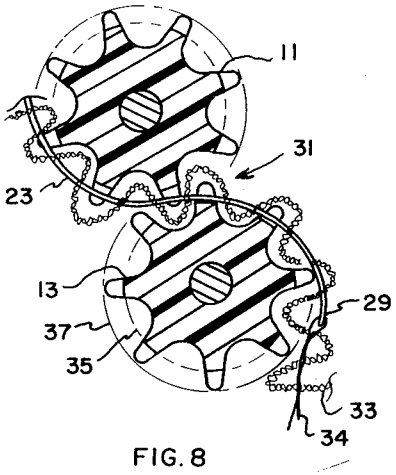
FIG. 8 is an enlarged sectional view of the exit pair of rollers having a needle with a curved eye end. This figure illustrates the positioning of the curved needle eye and relative to the lower of the set of intermeshing exit rollers.

FIG. 8 illustrates another embodiment of the invention wherein the needle eye end is curved to substantially approximate the curvature of arc 37. Again, it is stressed that the eye is located within the approximate range of 1/64" to $\frac{3}{8}$" externally of arc 37, measured in the direction of the radius of arc 37.

If desired, to further reduce loading during operation of the device, the rollers may be made of aluminum and impregnated with a friction reducing agent (e.g., polytetrafluoroethylene) impregnated annodized coating. Also, if desired, the needles may be provided with a low friction treatment or a coating of silicon or the like. Also, if desired, to further reduce loading during operation of the device, the needles may be coated with a friction reducing agent such as a silicone coating.

Ideally, to provide such a pleating machine in which continuous, uninterrupted operation may occur as a result of reduced friction between the needles and the fabric, the length of the needle would be such that the eye of the needle would be in contact with roller 13 and confined between rollers 11 and 13, thus requiring the eye to be positioned out of view between the rollers. Obviously, such construction would require special tools to thread the needles. It should be clearly seen, therefore, that the applicants have provided a pleating machine in which special threading tools are not required and in which the needle eye is sufficiently exposed to permit the needle to be threaded. Additionally, since the frictional contact between the needles and fabric material has been substantially eliminated by the reduction in needle length, permitting the last roller to propel the material off the end of the needle, the need to stop operation of the machine to remove the bunched fabric material from the needle has also been eliminated, resulting in a pleating machine capable of smooth, continuous, uninterrupted operation.

A further feature of applicants' invention is that self-threading needles may be used. An example of such self-theading needle eyes is the French spring eye type. The use of such self-threading needles is made possible because of the reduced frictional resistance of the needle to the fabric and the even force distribution applied to each fold/pleat by the teeth of the last roller gear of the exit pair of gears, which causes the fabric to be self-stripped off the needle.

Furthermore, applicants' invention permits the use of more pleating rows (more needles), and thus the machines can be larger. The number of needles used may be in the range of 26 to 62. Additionally, applicants' machine, because of reduced frictional loads, is compatible with power drives for continuous, non-stop, faster pleating, thus resulting in greater commercial appeal.

To permit the use of such larger power driven machines having an increased number of needles, it is necessary that sufficient torque be applied to the input drive of the upper exit roller to overcome the resistance offered by the needles. Obviously, the more needles that are used requires a larger torque. However, by the use of the needles described above, the required torque will be minimized for a given number of needles.

What we claim is:

1. In an apparatus for stitching and pleating or gathering textile and like material, said apparatus including a frame supporting a continuous train of at least four rotatable rollers formed with intermeshing teeth, said rollers including first and second pairs of rollers, each pair comprising upper and lower meshing rollers and each roller having registering circumferential grooves along the length thereof in spaced, substantially parallel relation, the improvement comprising:

a plurality of needles having a pointed tip for piercing said material as said material is fed into said apparatus and an eye end having a thread receiving eye for secured relation of thread therein, each said needle disposed to be supported in said registering circumferential grooves of said rollers, each said needle having a predetermined length and provided with a curved shank portion intermediate said tip and eye end, said tip positioned between a first of said pair of rollers, and said eye end positioned in the range of 1/64" to ⅜" outwardly of an arc prescribed by rotation of a point on the outer periphery of the lower of a second of said pair of rollers, the distance being measured in the direction of the radius of the arc, whereby, in response to said material being pierced by and gathered on said needles, said material is stripped from said needles and onto said thread by the lower of said second pair of rollers without interruption of the operation of said machine for manual stripping operation.

2. Apparatus as set forth in claim 1 wherein said shank portion is curved to include at least one S-bend.

3. Apparatus as set forth in claim 2 including a low friction coating provided on said needles.

4. Apparatus as set forth in claim 2 wherein said thread receiving eye is a self-threading eye.

5. In an apparatus as in claim 2 wherein said rollers are comprised of annodized aluminum impregnated with a friction reducing agent to reduce frictional forces between said rollers during operation of said apparatus.

6. An apparatus for stitching and pleating or gathering textile and like material, said apparatus including:

a frame;

first and second pairs of rotatable rollers formed with intermeshing teeth, each pair comprised of upper and lower meshing rollers, a roller of one pair intermeshing with a roller of the second pair to form a continuous train of gears, each roller having registering circumferential grooves along the length thereof in spaced, substantially parallel relation;

means for rotating said rollers; and needles adapted for mounting in said circumferential grooves, each needle including a shank portion having at least one S-bend therein, said shank portion provided with a thread receiving eye and a sharp tip, respectively, at first and second ends thereof, said tip being positioned at a point A in said apparatus and disposed for piercing said material as said material is fed into said apparatus and said thread receiving eye disposed for secured relation of said thread therein and positioned at a point B in said apparatus, where point A is defined as a point between said upper and lower rollers of said first pair of rollers, and point B is defined at a point positioned in the range of 1/64" to ⅜" outwardly from an arc prescribed by rotation of a point on the outer periphery of said lower of said second pair of rollers, the distance being measured in the direction of the radius of the arc, whereby, in response to said material being pierced by and gathered on said needles, said material is stripped from said needles and onto said thread by said lower of said second pair of rollers without interruption of the operation of the machine for manual stripping operation.

7. Apparatus as set forth in claim 6 including a low friction coating provided on said needles.

8. Apparatus as set forth in claim 6 wherein said thread receiving eye is a self-threading eye.

9. In an apparatus as in claim 6 wherein said rollers are comprised of impregnated annodized aluminum to reduce frictional forces between said rollers during operation of said apparatus.

10. Apparatus as set forth in claim 6 including a predetermined number of needles disposed in said grooves, the number of said needles being dependent upon application of a predetermined torque by said means for rotating said rollers, said torque being substantially reduced by inclusion in said apparatus of said needles which extend in the range of 1/64" to ⅜" outwardly of said arc prescribed by rotation of said point on the outer periphery of the lower of said second pair of rollers.

11. Apparatus as set forth in claim 10 wherein said number of needles is further defined as being in the range of from 26 to 62.

* * * * *